US006471207B1

(12) United States Patent
Schlaifer

(10) Patent No.: US 6,471,207 B1
(45) Date of Patent: Oct. 29, 2002

(54) SYSTEM AND METHOD FOR PLAYING A GAME OF KNOWLEDGE AND WAGERING

(75) Inventor: Roger L. Schlaifer, Atlanta, GA (US)

(73) Assignee: Odd's R Network, Inc.

( * ) Notice: Subject to any disclaimer, the term of this patent is extended or adjusted under 35 U.S.C. 154(b) by 0 days.

(21) Appl. No.: 09/496,501

(22) Filed: Feb. 2, 2000

(51) Int. Cl.[7] ..... A63F 3/00

(52) U.S. Cl. ..... 273/138.1; 273/236; 273/242; 273/243; 273/284; 273/287

(58) Field of Search ..... 273/138.1, 287, 273/284, 236, 242, 243, 258, 249, 248

(56) References Cited

U.S. PATENT DOCUMENTS

| | | | | | |
|---|---|---|---|---|---|
| D34,594 | S | * | 5/1901 | Brown | D34/5 |
| 1,625,055 | A | * | 4/1927 | Sandel | 273/236 |
| D112,805 | S | * | 1/1939 | Bratt | D34/5 |
| D137,838 | S | * | 5/1944 | McGrath | D34/5 |
| D211,529 | S | * | 6/1968 | Donnellon | D34/5 |
| 3,874,584 | A | | 4/1975 | Foley | |
| 4,109,918 | A | * | 8/1978 | Mele et al. | 273/256 |
| 4,129,304 | A | * | 12/1978 | Mager | 273/243 |
| 4,225,138 | A | * | 9/1980 | Wolf | 273/243 |
| 4,326,711 | A | | 4/1982 | Giallombardo | |
| 4,778,186 | A | * | 10/1988 | Dudley | 273/243 |
| 4,884,816 | A | * | 12/1989 | Ford et al. | 273/240 |
| 5,013,048 | A | * | 5/1991 | Turner | 273/242 |
| 5,066,015 | A | * | 11/1991 | Sumrall | 273/243 |
| 5,106,097 | A | * | 4/1992 | Levine | 273/237 |
| 5,129,649 | A | * | 7/1992 | Scholz | 273/236 |
| 5,342,058 | A | * | 8/1994 | Giovannetti | 273/243 |
| 5,480,157 | A | * | 1/1996 | Plummer | 273/432 |
| 5,647,795 | A | | 7/1997 | Stanton | |
| 5,791,649 | A | * | 8/1998 | DiSandro | 273/243 |
| 5,797,796 | A | | 8/1998 | Dickinson | |
| 5,816,819 | A | * | 10/1998 | Rockburn | 434/106 |
| 5,842,921 | A | | 12/1998 | Mindes et al. | |
| 5,906,371 | A | * | 5/1999 | Peterson | 273/249 |
| 5,941,525 | A | | 8/1999 | Gallub | |
| 5,984,306 | A | * | 11/1999 | Cotter et al. | 273/243 |
| 6,070,874 | A | * | 6/2000 | Ivers | 273/292 |
| 6,193,606 | B1 | * | 2/2001 | Walker et al. | 463/20 |
| 6,267,375 | B1 | * | 7/2001 | Bernstein et al. | 27/242 |

FOREIGN PATENT DOCUMENTS

GB 2 197 974 A * 6/1988 ..... G07F/17/34

OTHER PUBLICATIONS

McKenna, Harbard Web site calculates cancer risk, Atlanta Journal Constitution, Sep. 19, 2000, p. C4.

Internet Sportsbook and Virtual Casino, sportsbook.com, printed from the Internet, Sep. 6, 2001.

Fantasy Sports Games, sportsline.commissioner.com, printed from the Internet, Nov. 16, 2000.

Predict The Play Preview, foxsports.com, printed from the Internet, Nov. 16, 2000.

Terms of Service, buzztime.com, printed from the Internet, Nov. 16, 2000.

Play and Get Paid for Accuracy!, Predict A Game, printed form the Internet, Nov. 16, 2000.

(List continued on next page.)

*Primary Examiner*—Benjamin H. Layno
*Assistant Examiner*—D Collins
(74) *Attorney, Agent, or Firm*—Gardner Groff & Mehrman, P.C.

(57) ABSTRACT

A method is provided for allowing an active player and a plurality of opposing players to play a game by taking turns in an alternating manner. The method includes the step of providing a question to be answered by an active player. The opposing players the wager desired amounts on the active player's ability to answer said question. The active player then answers the question and the wagers are paid off or collected based upon the accuracy of the active player's answer.

36 Claims, 4 Drawing Sheets

OTHER PUBLICATIONS

Cyberskipper 2000, cyberskipper.com, printed from the Internet, Nov. 16, 2000.
Enhanced Television, Create your own Slide Shows at QComet.com, printed from the Internet, Nov. 9, 2000.
MedSurf, LLC, Honolulu, Hawaii, The future of e–medicine today, printed from the Internet, Sep. 6, 2001.
ABC Sports Online, Continuing the tradition of excellence, espn.go.com, Tallying the Votes, printed from the Internet, Nov. 16, 2000.
Rovner, Information in the palm of your hand, National Library of Medicine, PubMed, printed from the Internet, Aug. 10, 2000.

* cited by examiner

60
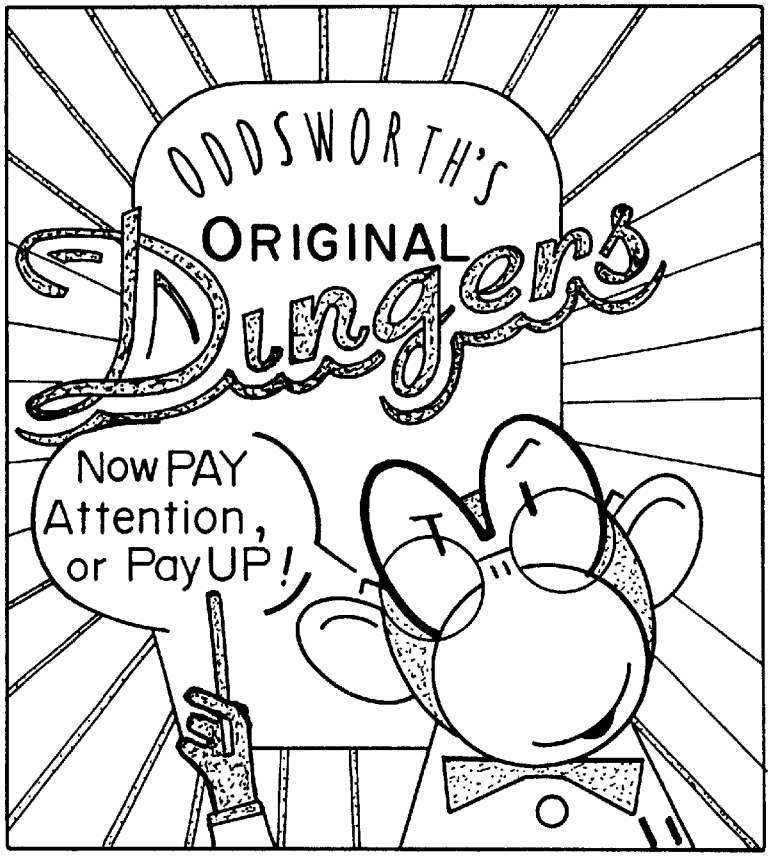
FIG. 4
QUESTION
Which of these big cats is most likely to be found in North America — the puma, the mountain, or the panther? 62
ANSWER
The odds are the same — all three names are for the same species of cats. 64
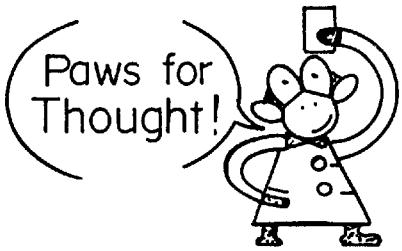

SYSTEM AND METHOD FOR PLAYING A GAME OF KNOWLEDGE AND WAGERING

BACKGROUND OF THE INVENTION

1. Field of the Invention

The present invention relates generally to games, and more particularly to a system and method for playing a game of knowledge and wagering. The game system allows players to wager upon the ability of themselves and/or other players to correctly answer information or trivia questions at particularly determined odds levels.

2. Description of Related Art

The prior art includes various trivia games which may be played by groups of individuals for entertainment purposes. Trivia games generally include questions on diverse subjects which are posed to individuals or teams of individuals. In some embodiments, questions have been assigned discreet point values related to their difficulty and the point at which they are posed during game play. Other trivia and information games have been developed which include board game elements, wherein the players move game pieces across the surface of a game board to determine the particular questions to be answered. These boardtype trivia games are particularly well suited to home or party use by small groups of players.

However, trivia board games have generally lacked a strategy component, instead concentrating solely on luck and knowledge. Incorporation of a strategy component, such as player wagering, into a trivia board game would serve to increase the entertainment value of the game. Additionally, the method of play in previous trivia board games typically involves little or no participation by the opposing players when a particular player is answering a question, thereby making the game less exciting than one in which all players may be continuously involved.

Thus, there is a need for an informational or trivia board game incorporating a strategy component such as player wagering. Furthermore, there is a need for an informational or trivia game which allows all players to participate and have a stake in the outcome of all phases of game play.

Accordingly, it is an object of the present invention to provide a game system and method which allows players to wager desired amounts of either points, currency or tokens upon their ability to answer trivia-type questions.

It is also an object of the present invention to provide a game system and method which allows players to wager desired amounts of either points or currency upon the ability of their opponents to answer informational or trivia-type questions.

It is yet another object of the present invention to provide a game system and method wherein players may bet upon their ability to answer a particular question at a preset odds level related to the difficulty of the particular question.

It is yet another object of the present invention to provide a game system and method wherein all players will participate throughout the play of the game.

SUMMARY OF THE INVENTION

A method is provided for allowing an active player and a plurality of opposing players to play a game by taking turns in an alternating manner. The method includes the step of providing a question to be answered by an active player. The opposing players wager desired amounts on the active player's ability to answer said question. The active player then answers the question and the wagers are paid off or collected based upon the accuracy of the active player's answer.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 4 illustrates a flowchart diagram representative of a method of playing a game in accordance with a preferred embodiment of the present invention.

DESCRIPTION OF THE PREFERRED EMBODIMENT

Figure 1:
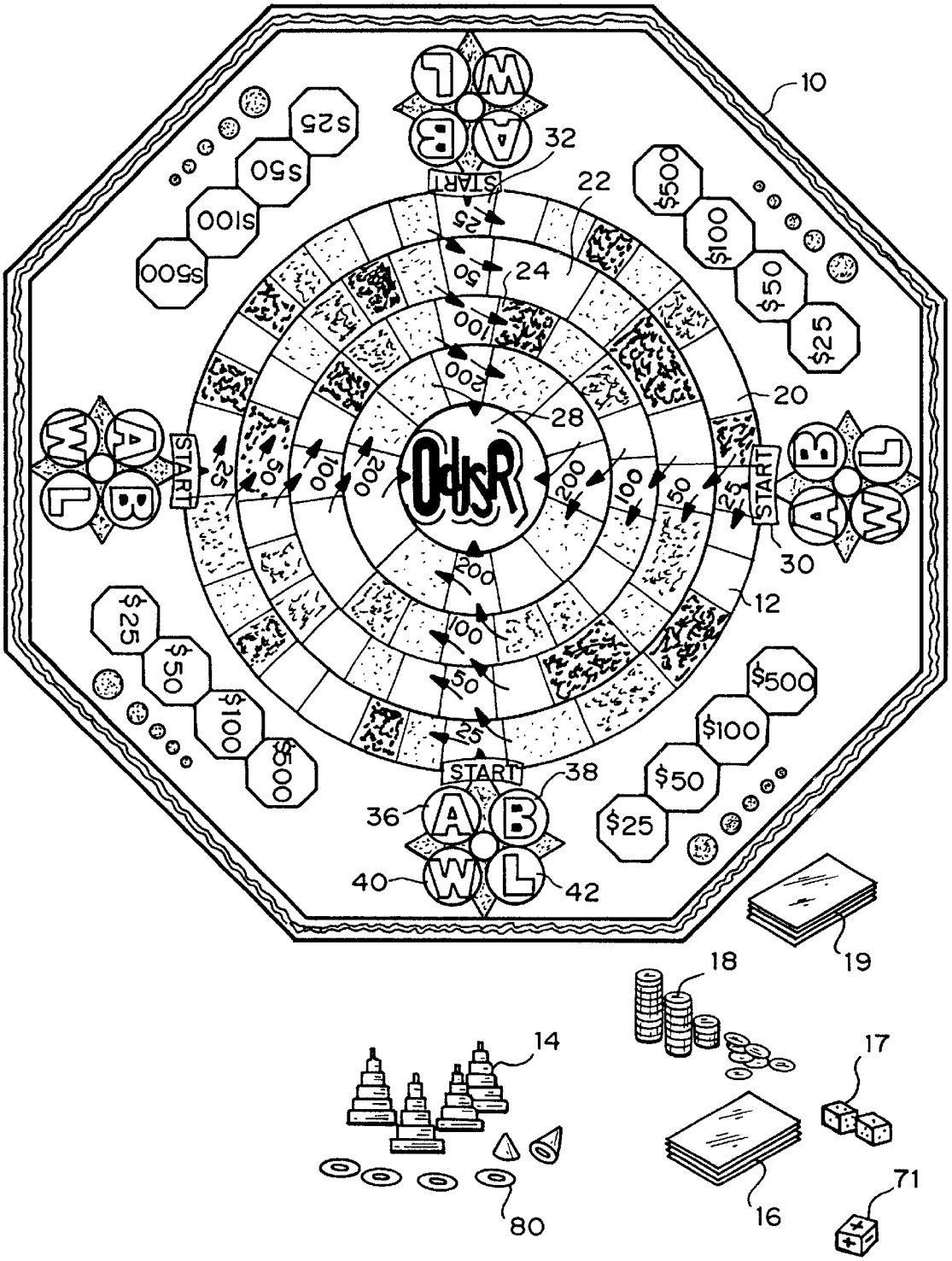
FIG. 1 illustrates an overhead view of a game system in accordance with the preferred embodiment of the present invention.

As shown in FIG. 1, game system A is provided for allowing a group of players to play a trivia-type board game. In a preferred embodiment, game system A includes a game board 10 having game spaces 12 and a plurality of game tokens 14 for moving thereabout to determine certain player actions. A plurality of question cards 16 are provided, having unique questions for testing the knowledge of players. A random number generator 17 is provided for allowing random number generation by players to determine the number of spaces which they should move their respective game tokens 14 during game play. A plurality of betting tokens 18 are also provided as a wagering medium for allowing players to wager upon their ability, and the ability of their opposing players to answer questions from question cards 16. Additionally, a plurality of lottery tickets 19 may optionally be included for allowing players to engage in lottery-type betting activities.

As illustrated in FIG. 1, in the preferred embodiment, game board 10 includes a plurality of game spaces 12 arranged into concentric pathways 20, 22, 24 and 26 disposed around a central lottery pool area 28, defining pathways along which players may move their respective game tokens 14. In the preferred embodiment, a plurality of player start spaces 30 are distributed about the outermost concentric ring 20 to designate the starting positions for the respective players. Concentric rings 20, 22, 24 and 26 are connected by a plurality of pass-through-zone spaces 32 which serve as transitions for allowing player's respective game tokens 14 to pass to and from adjacent concentric pathways 20, 22, 24, and 26 and to lottery pool area 28. In a preferred embodiment, specific pass-through-zone spaces 32 are associated with particular players, and the particular players may only utilize their respective associated pass through zone spaces 32.

Game board 10 also includes a plurality of wagering areas 34 upon which players may place betting tokens 18 during game play to indicate respective wagers. Wagering areas 34 each include an ante area 36 and a betting area 38 wherein players may position betting tokens 18 during the respective ante and wagering portions of game play. Outcome areas 40 and 42 respectively are provided for allowing a respective player to indicate that a particular wager is either for or against a player's ability to correctly answer a question during game play.

Game tokens 14 include distinguishing characteristics or indicia sufficient to associate each respective game token 14 with a particular player. In a preferred embodiment, each respective game token 14 has a conical similar to that used in many traditional board games and is distinctively colored to allow association with a particular player. Alternatively, each game piece may have distinctive shape for allowing association with a particular player, for example, geometric shape, an animal shape, a human shape or a vehicle shape.

Figure 2:
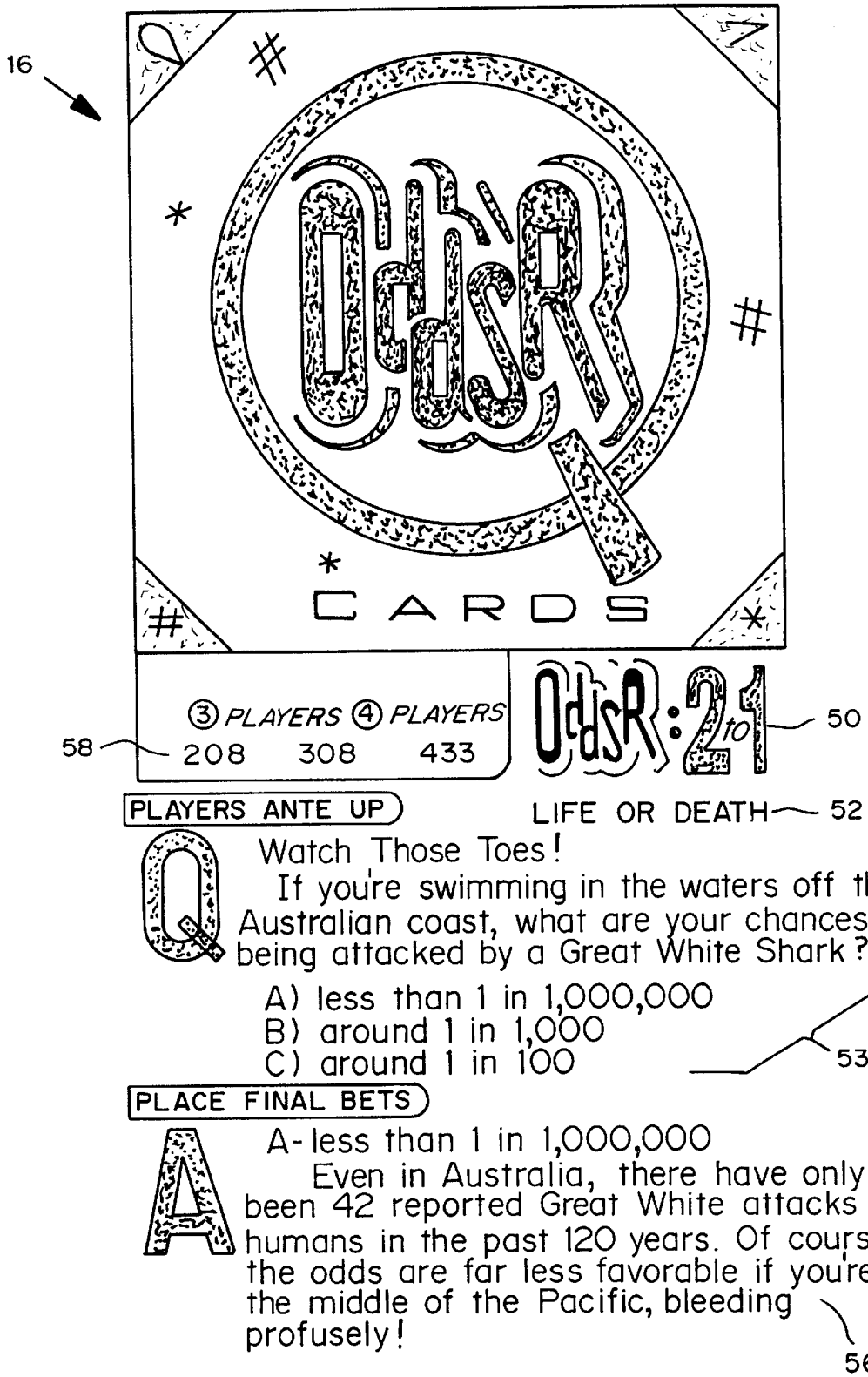
FIG. 2 illustrates a front view of a question card in accordance with the game system of the embodiment of FIG. 1.

FIG. 2 illustrates a front view of a question card 16 in accordance with a preferred embodiment of game system A. Each question card 16 includes an odds level 50, a category 52 to which the question card pertains, a multiple choice question 54 related to topic 52, and an answer 56. Optionally, each question card 16 may also include one or more lottery numbers 58 for allowing the players to engage in a game-related lottery by matching the numbers with those found on lottery tickets 19.

Random number generator 17 is included for generating random numbers for use by players when determining the number of spaces to move their respective game tokens 14 during a particular turn. In the preferred embodiment, random number generator 17 includes a plurality of dice 66 which the players may roll to generate random numbers. However, one of ordinary skill in the art will recognize that a number of other random number generating devices, such as cards, conventional game roulette-type spinners or electronic random number generators, would also suffice for generating random numbers in game system A.

While the game system described above includes physical components such as a game board 10, game tokens 14 question cards 16 and betting tokens 18, one of ordinary skill in the art will recognize that the game is also easily adaptable to play on a computer system. For example, virtual analogs of the above-mentioned physical components may easily be simulated and displayed to one or more players through use of a typical computer system while applying the rules of the present game invention.

Figure 3:
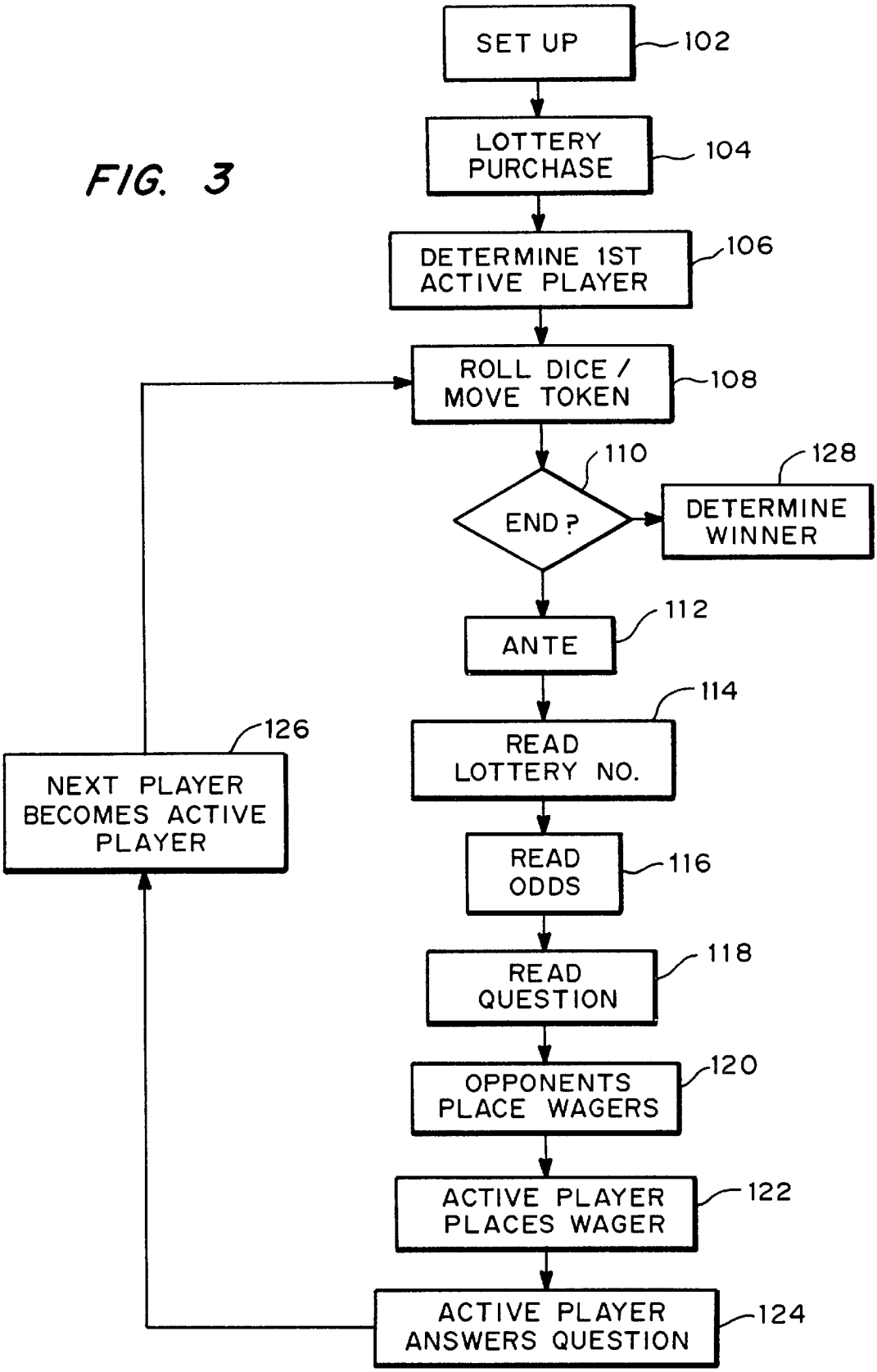
FIG. 3 illustrates a front view of a penalty question card in accordance with the game system of the embodiment of FIG. 1.

It is contemplated that, in a preferred embodiment, game system A may be utilized by players to play a game of knowledge and wagering according to the steps of the following basic game method illustrated in FIG. 3. At game set-up step 102, one of the plurality of players is selected to serve as the "house player." The house player is responsible for distributing a predetermined amount of betting tokens 18 to the remaining players and for matching winning bets by players and for collecting betting tokens 18 in response to losing bets by players. The house player is also responsible for placing a predetermined amount of betting tokens 18 into lottery pool area 28. Once a house player has been selected the remaining players select their desired game tokens 14 and position the tokens at appropriate positions for starting the game.

At step 104, each player is allowed to purchase a lottery ticket 19 for a specified fee. Fees collected from the players are placed in the lottery pool area 28, thereby increasing the amount therein. At various points during the game to be specified later, players will be given opportunities to purchase additional lottery tickets 19 and to match their accumulated lottery tickets 19 with randomly determined lottery numbers which serve as payout criteria for lottery pool 28. If a player matches one of his accumulated lottery tickets 19 to a randomly determined lottery number, that player will then collect the contents of the lottery pool area 28 and the lottery pool area 28 will be immediately restocked to its minimum size by the house. Thereafter, the amount of tokens in the lottery pool area 28 will also increase through accumulation of losing wagers and any player penalties which occur.

Next, at step 106, the players roll game dice 66 to determine which player will have the first turn. The player whose turn it is at any given time will hereinafter be referred to as the "active player." The remaining players will be referred to as the opposing players.

The active player then again rolls the game dice 66 at step 108 to determine how many spaces he will move his particular game token 14 along the particular concentric pathway 20, 22, 24, or 26 along which it lies. If the game token 14 currently is residing in a designated "pass through zone" 32 the game token 14 may be moved inward to the next respective concentric pathway 20, 22, 24, or 26 or to lottery pool area 28 if at the innermost concentric pathway 26. In either case the player's game token 14 must come to rest on a space of one or the other of the concentric pathways 20, 22, 24, or 26. When the active player moves his game token inward to a new concentric pathway 20, 22, 24, or 26, he may also draw an additional lottery ticket 19. Additionally, in the preferred embodiment, after the game token 14 has been moved, it is necessary to determine whether a game terminating criteria has been fulfilled at step 110.

If the game termination criteria was not fulfilled at step 110, a question card 16 is then drawn by the player to the right of the active player (the "caller") at step 112. All players must ante a minimum quantity of betting tokens 18. A given player antes by placing the appropriate amount of betting tokens 18 into his respective ante area 36. If any player has insufficient betting tokens 18 to meet the ante requirements he is out of the game. The "house" then matches the antes by placing an equivalent amount of betting tokens 18 into the ante area 36 for each respective player. In the preferred embodiment, all bets are transacted directly between individual players and the house, rather than between individual players.

In the preferred embodiment, each concentric pathway 20, 22, 24, and 26 is associated with a particular minimum betting amount. The minimum betting amount at a given point in game play is equal to the minimum betting amount associated with the concentric pathway 20, 22, 24, or 26 wherein the active player's game token 14 resides. Preferably, the minimum betting amounts of concentric pathways 20, 22, 24, and 26 increase towards the center of game board 10.

The caller then reads the associated lottery number 58 from the question card at step 114. If the lottery number 58 matches a lottery ticket 19 held by the active player then the active player may collect the accumulated betting tokens 18 from the lottery pool area 28. Only the active player may win the lottery pool, therefore matches by other opposing players have no effect. This step is repeated during each players' turn throughout the course of the game, ensuring that all players have a chance to win the lottery during those turns in which they are the active player.

The caller next reads the odds level 50 from the respective question card at step 116. The house then adds additional betting tokens 18 to the active player's ante area 36 to match the odds level 50 specified on the question card 16. For example, if the minimum betting amount for the respective concentric pathway 20, 22, 24, or 26 is $50 and the specified odds are 3:1, then the house adds betting tokens equating to $150. Only the active players' wagers are matched at the given odds level. All wagers by opposing players are always at a 1:1 odds level.

Once all antes have been met, at step 118, the caller reads aloud both the category 52 of the respective question and the respective question 54 itself. The caller shows the answer of the question to the opposing players.

At step 120, each opposing player must place an additional bet in an outcome area 40 or 42, in addition to the ante, or forfeit the amount tokens previously placed into ante area 36. The additional bet placed by each opposing player must be between one and five times minimum betting amount for the respective concentric pathway 20, 22, 24, or 26 wherein the active player's game token 14 resides. The opposing players specify whether their respective bets will pay out on a correct or incorrect answer by placing betting tokens 18 in respective win or loss outcome areas 40 and 42 respectively of betting area 38.

Once all opposing player bets have been made, at step 122, the active player may bet up to five times the ante amount at the respective odds level 50 associated with the particular question card 16 in play. However, unlike the opposing players, the active player is not required to bet to avoid forfeiting his ante. The house matches the additional wager by active player at the odds level 50 specified on the particular question card 16.

Next, at step 124, the active player either correctly or incorrectly answers the particular question 54 and the wagers are settled as appropriate. Loosing wagers are collected by the house and placed in the lottery pool area 28.

The next player then becomes the active player at step 126 and game play returns to step 108, initiating a new turn. Play continues cyclically in this fashion until a player fulfills the game termination criteria as determined at step 110. In the preferred embodiment, the game termination criteria is fulfilled when a player successfully moves his game token 14 into the central lottery pool area 28 by an exact roll of the game dice 66. The player having the highest total of betting tokens 18 is declared the winner.

In the preferred embodiment, the basic game method of FIG. 3 may be subject to a variety of conditional modifications. For example, a subset of the spaces on the game board 10 may be designated as action spaces 70, wherein an active player or his opponents may be required to perform specified actions when a player's game token 16 comes to rest upon the action space 70. For example and not limitation, an action space 70 may: multiply the distance the active player moves his game token 14 during the turn (a "Multiplier"space); direct a player to draw a random event from a grab bag ("Grab Bags™" space); double the wager in the current turn ("Double Dog Dare™" space), direct the active player to call heads or tails and, if correct, pay the active player a specified amount ("CowChipFlip™" space); or reverse the odds of the question so that the active player risks more than his potential payoff ("SnakeBite™" space). All penalties paid by the active player from any action space events are placed in the lottery pool area 28. In a further preferred embodiment, a player landing on a "Multiplier" space must also roll a directional die 71, having two negative and four positive sides, to determine whether the player should move his respective game token 14 in a forward or reverse direction In another embodiment, game system A may also include a penalty system for limiting the active player's option of "tanking" questions when the opposing players have placed substantial bets upon the active player's ability to answer correctly. For example, when the active player incorrectly answers a question 54 he may be given a penalty token 80. In the preferred embodiment, penalty token 80 has a annular "ring" shape allowing it to be placed upon the active player's respective conically shaped game token 14. When a player accumulates five penalty tokens 80, he enters a penalty state (gets "dunced") whereupon he must pay a fee and answer a specific penalty question 62 from a penalty question card 60 instead of taking a normal turn.

In the preferred embodiment, as illustrated in FIG. 4, each penalty question card 60 includes a penalty question 62 and an associated answer 64. Penalty question cards 60 differ from regular question cards 16 in that they are not multiple choice, do not include an associated odds level 50 and do not include lottery numbers 58. No wagers are placed on the penalty questions 62. If the player correctly answers the penalty question, he may divest himself of all penalty tokens and retrieves his fee. If the player misses the penalty question, he loses his fee and must retain his penalty tokens. The player cannot move or divest himself of his penalty tokens without first correctly answering a penalty question. Optionally, the player may pay an enhanced fee to divest himself of penalty tokens.

In another optional embodiment, players may utilize game system A to wager directly against opponents, rather than against the house as was the case in the preferred embodiment. In this alternate embodiment, the opposing players may challenge the active player and bet directly that he does not know the answer to the question card in play. If no one challenges the active player, he is free to wager against the house at double the odds indicated on the question card 16 in play. For example, if the question in play has an odds level of 3:1 and no opposing player chooses to challenge the active player, the active player may them place a wager against the house at the doubled odds level of 6:1. Therefore, the opposing players must also strategically consider whether they can afford to let the active player win a wager at such high odds, adding to the strategic nature of the game.

Thus, it may be seen, that an advantageous game system is provided according to the present invention. The use of a trivia-type board game including wagering elements provides an entertaining and strategically challenging game which is well suited for home or party type uses. In addition to testing their knowledge, players are allowed to strategically test their assessment of the knowledge and skill of opposing players by betting upon their opponent's answering ability to answer their respective questions. Thus, the benefits of a conventional trivia game are combined with the strategic elements of a wagering game. Furthermore, because all players are allowed to wager and have a stake in the outcome of all phases of game play, the interest level of the players is maintained, heightening their enjoyment.

It thus will be appreciated that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A method for playing a game for use by an active player and one or more opposing players, said method comprising the steps of:

providing a question to be answered by said active player;

wagering of amounts by all of said opposing players on whether said active player will correctly or incorrectly answer said question;

answering of said question by said active player; and paying off and collecting said wagers based upon whether said active player's answer is correct or incorrect.

2. The method of claim 1, further including the step of wagering of an amount by said active player on whether said active player will correctly answer said question.

3. The method of claim 2, wherein said question has an associated odds level and wherein said step of paying off and collecting said wagers includes paying to said active player said wager amount adjusted by said associated odds level if said active player correctly answers said question.

4. The method of claim 1, further comprising the steps of:

providing a game board having a plurality of spaces;

providing a plurality of game tokens each corresponding to one of said players;

moving said active player's game token a randomly generated number of said spaces on said game board to a current space; and determining a minimum betting amount based upon a location of said current space on said board game, wherein said desired amounts wagered by said opposing players must be greater than or equal to said minimum betting amount.

5. The method of claim 1, further comprising the steps of:

permitting said opposing players to challenge said active player by wagering directly with said active player; and if none of said opposing players challenges him, permitting said active player to wager at an increased odds level that is higher than said odds level associated with said question.

6. The method of claim 1, wherein said step of wagering of amounts includes the step of wagering an ante amount by all of said players before said step of providing said question, and further including the step of forfeiting said ante amount by any of said opposing players if they do not subsequently and additionally place said wager on whether said active player will correctly or incorrectly answer said question.

7. The method of claim 1, further including the step of offering an opportunity to wager to said active player, wherein said active player may wager or pass on said opportunity to wager.

8. The method of claim 3, wherein said step of paying off and collecting said wagers includes paying to or collecting from said opposing players an amount that is not adjusted by said odds level.

9. A game system for allowing a plurality of players to play a game by taking turns in an alternating manner, said game system comprising:

a plurality of game tokens, each game token having a distinctive characteristic for allowing association of said game token with a respective one of said players;

a wagering medium for indicating wager amounts;

a game board having a continuous pathway with a plurality of spaces defined therein where said players may position said game tokens during game play, wherein said spaces include at least one start space, at least one finish space, and a plurality of intermediate spaces between said start space and said finish space, wherein said intermediate spaces are grouped into segments with each segment having associated therewith a minimum wagering amount for players whose tokens are positioned therein;

a plurality of questions, each question having an odds level associated therewith; and a random number generator for generating random numbers, wherein each one of said players may, during his respective turn, utilize said random number generator to generate one of said random numbers, move said respective game token said random number of said spaces, have one of said questions asked of him, use said wagering medium to indicate one of said wager amounts not less than said minimum wagering amount, answer said question, and pay or collect based on whether said answer was correct or incorrect and on said odds level.

10. The game system of claim 8, wherein said continuous pathway is formed by a plurality of concentric strips with said spaces defined therein, wherein said spaces further include a plurality of transition spaces that interconnect said concentric strips.

11. The game system of claim 9, wherein each of said concentric strips defines one of said segments with one of said minimum wagering amounts.

12. The game system of claim 10, wherein said minimum betting amount is different for each of said concentric strips, wherein an innermost of said strips has a higher minimum betting amount than an outermost of said strips.

13. The game system of claim 8, wherein a subset of said plurality of spaces includes instructions for said respective player to perform a specified action.

14. The game system of claim 8, wherein a subset of said plurality of spaces includes indicia for multiplying said odds level at which said respective player must wager.

15. The game system of claim 8, wherein said board includes wagering areas including ante areas for placing quantities of said wagering medium wagered by said players before each of said questions are asked and betting areas for placing quantities of said wagering medium wagered by said players after each of said questions are asked.

16. The game system of claim 14, wherein said board further includes outcome areas for indicating whether said wagers are on said player correctly or incorrectly answering said question.

17. The game system of claim 8, wherein said game board and said game tokens are provided by virtual representations thereof that are displayed to said players via a computer system.

18. A method for playing a board game for use by an active player and one or more opposing players, said method comprising the steps of:

providing a game board having a continuous pathway with a plurality of spaces defined therein, wherein said spaces include at least one start space, at least one finish space, and a plurality of intermediate spaces between said start space and said finish space, wherein said intermediate spaces are arranged in concentric strips each having associated therewith a different minimum wagering amount;

providing a plurality of game tokens each corresponding to one of said players;

providing a lottery pool with a contents;

designating a lottery payout criterion;

wagering an ante amount by all of said players;

moving said active player's game token a randomly generated number of said spaces on said game board to a current space in a current one of said concentric strips;

providing a question to be answered by said active player, said question having an associated odds level and an associated lottery ticket number;

determining whether said lottery ticket number satisfies said lottery payout criterion and, if so, paying out said contents of said lottery pool to said active player;

determining a minimum betting amount based upon said current concentric strip;

providing all of said players an opportunity to wager on whether said active player will correctly or incorrectly answer said question;

wagering by said active player at said associated odds level of an amount based on whether he will correctly answer said question, wherein said amounts wagered by said active player must be greater than or equal to said minimum betting amount;

wagering by all of said opposing players of amounts on whether said active player will correctly or incorrectly answer said question, wherein said amounts wagered by said opposing players must be greater than or equal to said minimum betting amount;

forfeiting said ante amount by any of said opposing players who do not subsequently and additionally place said wager on whether said active player will correctly or incorrectly answer said question;

answering by said active player of said question; and paying off and collecting said wagers based upon whether said active player's answer is correct or incorrect, including paying to said active player said respective wager amount adjusted by said associated odds level if said active player correctly answers said question and collecting from said active player said respective wager amount if said active player incorrectly answers said question, and including paying to or collecting from said opposing players said respective wager amounts without adjusting by said odds level;

alternating turns so that one of said opposing players becomes said active player; and repeating said step of alternating until one of said players wins said game.

19. The method of claim 18, further comprising the steps of:

permitting said opposing players to challenge said active player by wagering directly with said active player; and if none of said opposing players challenges him, permitting said active player to wager at an increased odds level that is higher than said odds level associated with said question.

20. The method of claim 18, further including the step of penalizing said active player for incorrectly answering a predetermined number of said questions by requiring said active player to correctly answer a penalty question before he can continue with said method.

21. The method of claim 20, further including the step of providing a plurality penalty tokens, wherein said step of penalizing said active player includes at least partially supporting at least one of said penalty tokens on said active player's game token and removing all or at least one of said penalty tokens from said active player's game token for correctly answering said penalty question.

22. A game system for allowing a plurality of players to play a game by taking turns in an alternating manner, said game system comprising:

a plurality of game tokens, each game token having a distinctive characteristic for allowing association of said game token with a respective one of said players;

a plurality of penalty tokens that are removably supportable on said game tokens to indicate that said respective player has incorrectly answered a predetermined number of said questions;

a wagering medium for indicating wager amounts;

a game board having a continuous pathway with a plurality of spaces defined therein where said players may position said game tokens during game play, wherein said spaces include at least one start space, at least one finish space, and a plurality of intermediate spaces between said start space and said finish space, wherein said intermediate spaces are grouped into segments with each segment having associated therewith a minimum wagering amount for players whose tokens are positioned therein;

a plurality of questions, each question having an odds level associated therewith; and a random number generator for generating random numbers, wherein each one of said players may, during his respective turn, utilize said random number generator to generate one of said random numbers, move said respective game token said random number of said spaces, have one of said questions asked of him, use said wagering medium to indicate one of said wager amounts not less than said minimum wagering amount, answer said question, and pay or collect based on whether said answer was correct or incorrect and on said odds level.

23. The game system of claim 22, wherein said board includes wagering areas including ante areas for placing quantities of said wagering medium wagered by said players before each of said questions are asked and betting areas for placing quantities of said wagering medium wagered by said players after each of said questions are asked.

24. The game system of claim 22, wherein said game board and said game tokens are provided by virtual representations thereof that are displayed to said players via a computer system.

25. A method for playing a game for use by an active player and one or more opposing players, said method comprising the steps of:

providing a game board, game tokens, and penalty tokens;

providing a question to be answered by said active player;

wagering of amounts by all of said opposing players on whether said active player will correctly or incorrectly answer said question penalizing said active player for incorrectly answering a predetermined number of said questions by at least partially supporting at least one of said penalty tokens on said active player's game token;

answering of said question by said active player; and paying off and collecting said wagers based upon whether said active player's answer is correct or incorrect.

26. The method of claim 25, wherein said step of penalizing said active player includes requiring said active player to correctly answer a penalty question before he can continue with said method.

27. The method of claim 25, further including the steps of asking a penalty question and removing all or at least one of said penalty tokens from said active player's game token for correctly answering said penalty question.

28. A method for playing a game for use by an active player and one or more opposing players, said method comprising the steps of:

providing a question to be answered by said active player;

providing an odds level associated with said question;

wagering of amounts by all of said opposing players against a bank on whether said active player will correctly or incorrectly answer said question;

permitting said opposing players to challenge said active player by wagering directly with said active player, and if none of said opposing players challenges him, permitting said active player to wager at an increased odds level that is higher than said odds level associated with said question, but only permitting said active player to wager at said increased odds if none of said opposing players challenges said active player so that said opposing players are encouraged to challenge said active player to prevent said active player from receiving increased payouts based on said increased odds;

answering of said question by said active player; and paying off and collecting said wagers based upon whether said active player's answer is correct or incorrect.

29. The method of claim 28, further comprising the steps of:

providing a game board having a plurality of spaces;

providing a plurality of game tokens each corresponding to one of said players;

moving said active player's game token a randomly generated number of said spaces on said game board to a current space; and determining a minimum betting amount based upon a location of said current space on said board game, wherein said desired amounts wagered by said opposing players must be greater than or equal to said minimum betting amount.

30. The method of claim 28, wherein said step of wagering of amounts includes the step of wagering an ante amount by all of said players before said step of providing said question, and further including the step of forfeiting said ante amount by any of said opposing players if they do not subsequently and additionally place said wager on whether said active player will correctly or incorrectly answer said question.

31. A method for playing a game for use by an active player and one or more opposing players, said method comprising the steps of:

providing a question to be answered by said active player;

wagering of amounts by all of said opposing players on whether said active player will correctly or incorrectly answer said question;

answering of said question by said active player;

penalizing said active player for incorrectly answering a predetermined number of said questions, wherein said predetermined number is selected to discourage said active player from providing intentionally incorrect answers when said opposing players wager that said active player's answer will be correct; and paying off and collecting said wagers based upon whether said active player's answer is correct or incorrect.

32. The method of claim 31, wherein said step of penalizing said active player includes requiring said active player to correctly answer a penalty question before he can continue with said method.

33. The method of claim 31, further including the step of providing a game board, game tokens, and penalty tokens, wherein said step of penalizing said active player includes at least partially supporting at least one of said penalty tokens on said active player's game token.

34. A game system for allowing a plurality of players to play a game by taking turns in an alternating manner, said game system comprising:

a plurality of game tokens, each game token having a distinctive characteristic for allowing association of said game token with a respective one of said players;

a wagering medium for indicating wager amounts;

a game board having a continuous pathway with a plurality of spaces defined therein where said players may position said game tokens during game play, wherein said spaces include at least one start space, at least one finish space, and a plurality of intermediate spaces between said start space and said finish space, wherein said intermediate spaces are grouped into segments with each segment having associated therewith a minimum wagering amount for players whose tokens are positioned therein, wherein said continuous pathway is formed by a plurality of concentric strips with said spaces defined therein, wherein said spaces further include a plurality of transition spaces that interconnect said concentric strips, wherein each of said concentric strips defines one of said segments with one of said minimum wagering amounts wherein said concentric strips are configured in a spiral arrangement and an innermost of said strips has a higher or lower minimum betting amount than an outermost of said strips;

a plurality of questions, each question having an odds level associated therewith; and a random number generator for generating random numbers, wherein each one of said players may, during his respective turn, utilize said random number generator to generate one of said random numbers, move said respective game token said random number of said spaces, have one of said questions asked of him, use said wagering medium to indicate one of said wager amounts rot less than said minimum wagering amount, answer said question, and pay or collect based on whether said answer was correct or incorrect and on said odds level.

35. The game system of claim 34, wherein said board includes wagering areas including ante areas for placing quantities of said wagering medium wagered by said players before each of said questions are asked and betting areas for placing quantities of said wagering medium wagered by said players after each of said questions are asked.

36. The game system of claim 34, wherein said game board and said game tokens are provided by virtual representations thereof that are displayed to said players via a computer system.

* * * * *

UNITED STATES PATENT AND TRADEMARK OFFICE

CERTIFICATE OF CORRECTION

PATENT NO. : 6,471,207 B1 
DATED : October 29, 2002
INVENTOR(S) : Schlaifer, Roger L.

It is certified that error appears in the above-identified patent and that said Letters Patent is hereby corrected as shown below:

Column 6,
Line 60, Claim 1 should read as follows:

1. A method for playing a game for use by an active player and one or more opposing players, said method comprising the steps of:

providing a question to be answered by said active player;

providing a lottery ticket number associated with each question;

providing a lottery pool with a contents;

designating a randomly determined payout criterion;

determining whether said lottery ticket number satisfies said payout criteria; and paying out said contents of said lottery pool to said active player if said lottery ticket number satisfies said payout criterion;

wagering of amounts by all of said opposing players on whether said active player will correctly or incorrectly answer said question;

answering of said question by said active player; and paying off and collecting said wagers based upon whether said active player's answer is correct or incorrect.

Column 7,
Line 24, Claim 5 should read as follows:

5. The method of Claim 3, further comprising the steps of:

permitting said opposing players to challenge said active player by wagering directly with said active player; and if none of said opposing players challenges him, permitting said active player to wager at an increased odds level that is higher than said odds level associated with said question.

Line 43, Claim 8 should read as follows:

8. A game system for allowing a plurality of players to play a game by taking turns in an alternating manner, said game system comprising:

a plurality of game tokens, each game token having a distinctive characteristic for allowing association of said game token with a respective one of said players;

a wagering medium for indicating wager amounts;

UNITED STATES PATENT AND TRADEMARK OFFICE

CERTIFICATE OF CORRECTION

PATENT NO. : 6,471,207 B1
DATED : October 29, 2002
INVENTOR(S) : Schlaifer, Roger L.

It is certified that error appears in the above-identified patent and that said Letters Patent is hereby corrected as shown below:

Column 7, cont'd, a game board having a continuous pathway with a plurality of spaces defined therein where said players may position said game tokens during game play, wherein said spaces include at least one start space, at least one finish space, and a plurality of intermediate spaces between said start space and said finish space, wherein said intermediate spaces are grouped into segments with each segment having associated therewith a minimum wagering amount for players whose tokens are positioned therein, and wherein said board includes a lottery area for storing quantities of said wagering media associated with lost player wagers;

lottery tickets having lottery numbers marked thereon for matching with randomly-generated lottery numbers to win said wagering media from said lottery area;

a plurality of questions, each question having an odds level associated therewith; and a random number generator for generating random numbers wherein each one of said players may, during his respective turn, utilize said random number generator to generate one of said random numbers, move said respective game token said random number of said spaces, have one of said questions asked of him, use said wagering medium to indicate one of said wager amounts not less than said minimum wagering amount, answer said question, and pay or collect based on whether said answer was correct or incorrect and on said odds level.

Signed and Sealed this

Thirteenth Day of May, 2003

JAMES E. ROGAN
*Director of the United States Patent and Trademark Office*